United States Patent [19]

Kuntzmann et al.

[11] Patent Number: 4,572,985

[45] Date of Patent: Feb. 25, 1986

[54] TRAVELING WAVE TUBE COMPRISING A SLEEVE CUT WITH GROOVES AND ITS MANUFACTURING PROCESS

[75] Inventors: Jean-Claude Kuntzmann, Boulogne; René Nazet, Eaubonne; Louis Tarreau, Paris, all of France

[73] Assignee: Thomson-CSF, Paris, France

[21] Appl. No.: 594,230

[22] Filed: Mar. 28, 1984

[30] Foreign Application Priority Data

Mar. 31, 1983 [FR] France ..... 83 05362

[51] Int. Cl.[4] ..... H01J 25/34

[52] U.S. Cl. ..... 315/3.5; 315/3.6

[58] Field of Search ..... 315/3.5, 3.6

[56] References Cited

U.S. PATENT DOCUMENTS

| | | | |
|---|---|---|---|
| 2,869,217 | 1/1959 | Saunders | 315/3.5 |
| 3,271,614 | 9/1966 | Scott | 315/3.5 |
| 3,374,388 | 3/1968 | Huber | 315/3.5 |
| 3,508,108 | 4/1970 | Salisbury | 315/3.5 |

FOREIGN PATENT DOCUMENTS

| | | |
|---|---|---|
| 2454694 | 11/1980 | France . |
| 984607 | 2/1965 | United Kingdom . |

*Primary Examiner*—H. Dixon

*Attorney, Agent, or Firm*—Roland Plottel

[57] ABSTRACT

A helix-type delay line borne by a conical surface. The internal surface of a sleeve has grooves into which are inserted dielectric supports of constant height that are affixed to the helix-type delay line, and the depth of the grooves increases with the diameter of the line.

8 Claims, 7 Drawing Figures

FIG_1
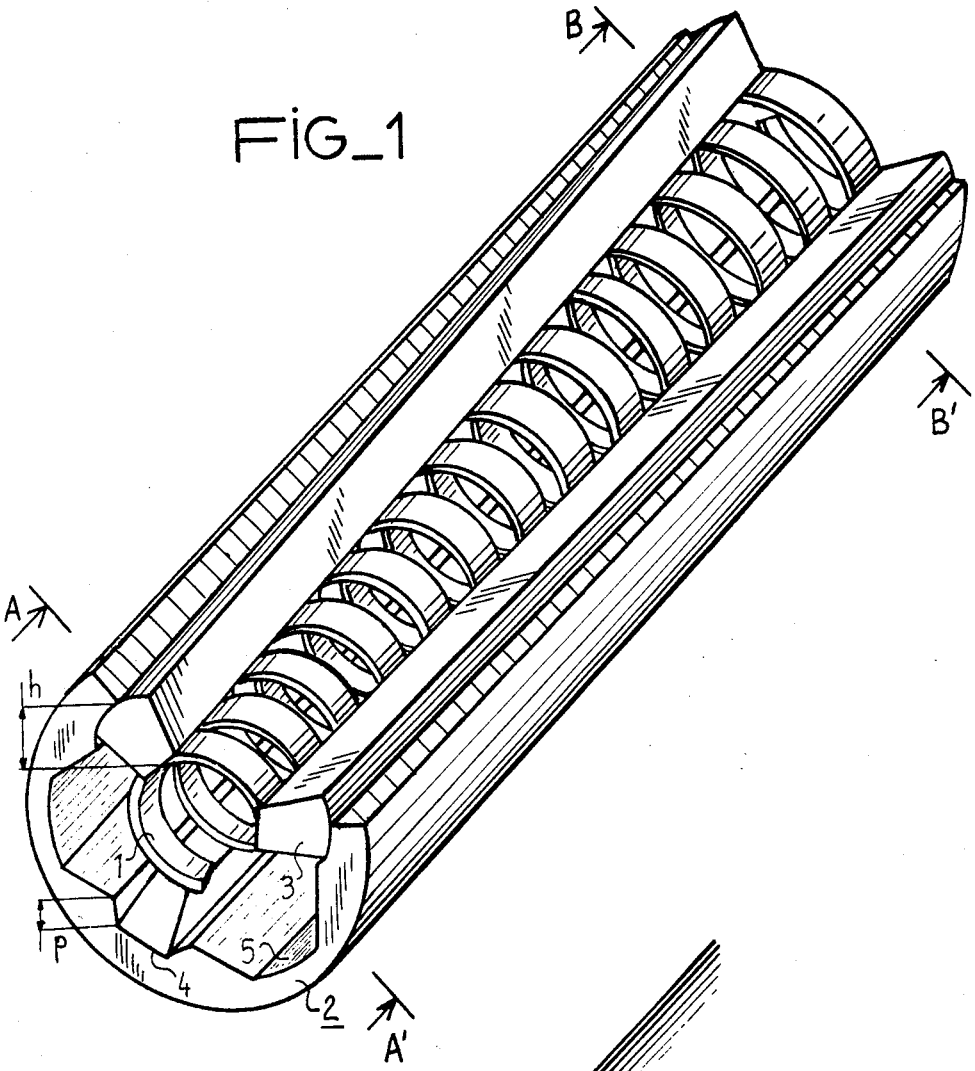
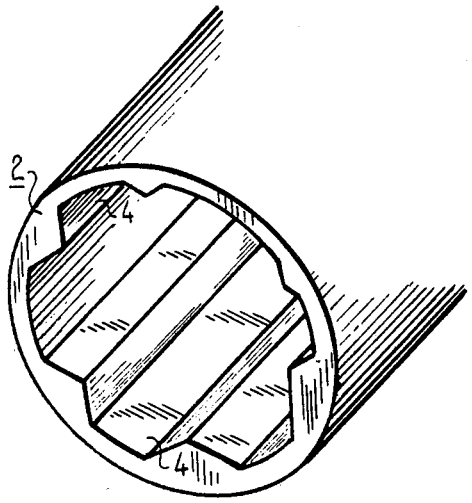
FIG_2

TRAVELING WAVE TUBE COMPRISING A SLEEVE CUT WITH GROOVES AND ITS MANUFACTURING PROCESS

BACKGROUND OF THE INVENTION

The present invention concerns a traveling wave tube comprising a sleeve cut with grooves. It also relates to a process for manufacturing the sleeve cut with grooves.

The invention concerns the field of traveling wave tubes having a helix-type delay line, i.e. for example, a simple helix delay line, or a "ring and bar" or "ring and loop" delay line.

However, in order to simplify the present description, the "delay line" referred to herein-below will be understood to be a simple helix.

The helix delay line is placed in a cylindrical sleeve, which is generally metallic, to which it is fixed through the intermediary of dielectric supports.

For traveling wave tubes operating at relatively low power levels, the helix and the supports are assembled by clamping in the sleeve. The helix is made of tungsten, for example, and the supports are made for example of quartz, alumina, glucina or boron nitride. The sleeve can be made of copper or stainless steel.

For traveling wave tubes operating at high power levels, the helix is brazed to the dielectric supports that are brazed to the sleeve. The helix can thus be made of copper, like the sleeve, and the dielectric supports can be made for example of beryllium oxide.

Three dielectric supports are generally used that are regularly disposed at 120° from one another.

In traveling wave tubes, in particular, in wide-band tubes operating at a high power level, noise or interference oscillations are produced at frequencies where the dephasing of the hyper-frequency wave transmitted is close to $\pi$ between two consecutive turns of the helix.

In order to avoid these oscillations, it is known to cause to vary the length of the turns of the helix along the axis of the tube and, correlatively, the pitch of the helix in order to maintain the synchronism conditions in the operating frequency band.

Helixes, called conical helixes, wound on a conical mandrel and the pitch of which increases in the same ratio as the diameter have been realized.

The practical realization of these conical helixes is difficult, above all when the helix, dielectric supports and sleeve are brazed.

When the focussing of the tube is realized by permanent magnets periodically alternated at frequent intervals, which is often the case, it is preferable to dispose of an externally cylindrical sleeve in order to support the annular magnets and the currently manufactured pole pieces. A sleeve can thus be used which is internally and externally cylindrical and dielectric supports having an appropriate outline, i.e. comprising a cylindrical surface in contact with the sleeve and a conical surface in contact with the helix. The drawback of this solution is that these very particular supports are expensive and difficult to realize.

In order to overcome these drawbacks, the applicant proposed in French Pat. No. 76.28319, published under No. 365 218, a pseudo-conical helix presenting flat parts parallel to the axis of the tube and at a constant distance from it. This solution allows the utilization of a cylindrical sleeve and dielectric supports of constant height.

The drawback of pseudo-conical helixes is that when the hyper-frequency power increases, noise or interference oscillations can be produced, close to mode $\pi$, towards the high frequency output of the tube there where the high frequency field is the highest, while for these power levels, no oscillations are produced if truly conical helixes are used. Indeed, conical helixes present the advantage of combining a variation of the length of the turns along the axis of the tube with a decrease of coupling impedance the more important the frequency is higher. This has the effect of sharply reducing the energy transfer to close to mode $\pi$ and due to this of suppressing oscillations. It should be noted that calculations and experiences have shown that, contrary to what was admitted, the coupling impedance between the hyper-frequency field and the electrons beam does not have to be maximal along all the length of the tube and that, in particular, the interaction ouput can be improved with a coupling impedance decreasing towards the end of the line, there where the HF field is maximum.

The present invention allows to overcome the problem that consists in manufacturing a traveling wave tube with a conical helix, currently manufactured dielectric supports of a constant height and an externally cylindrical sleeve.

DESCRIPTION OF THE PRIOR ART

Through various documents such as British Pat. No. 984 607 and U.S. Pat. No. 3,271,614, traveling wave tubes are known with a helix-type delay line, borne by a cylindrical surface, and with a sleeve the internal surface of which bears grooves, of constant depth, into which are inserted dielectric supports of constant height.

Through U.S. Pat. No. 3,374,388 are known tubes distinguished from those described herein-above since the helix is fixed in the sleeve the intermediary not only of dielectric supports of constant height, but also of metallic pieces of increasing height, the dielectric supports and the metallic pieces being inserted in grooves of increasing depth.

It will be noted that in all these documents, there is no question, as with the present invention, of conical helixes being used.

SUMMARY OF THE INVENTION

The present invention concerns a traveling wave tube comprising a helix-type delay line placed in a sleeve, cut with grooves to which it is fixed through the intermediary of dielectric supports of constant height inserted in the grooves, wherein the helix-type delay line is borne by a conical surface and the depth of the grooves increases with the diameter of the line. The sleeve can be manufactured by hammering around a core. The external face of the sleeve is thereafter lathe-machined in order to render it cylindrical and adapted to receive a focalization device by periodic permanent magnets.

BRIEF DESCRIPTION OF THE DRAWING

Other objects, characteristics and results of the invention will become apparent from reading through the present description, given by way of non-limitative example and illustrated by the annexed figures that represent:

FIGS. 1 and 2, views in perspective showing the sleeve and its grooves and the position of the helix and of its supports in the sleeve FIGS. 3 to 5, transversal cross-section views showing the supports inserted in their grooves ahd the different types of supports that can be used.

DESCRIPTION OF THE PREFERRED EMBODIMENTS

Figure 3:
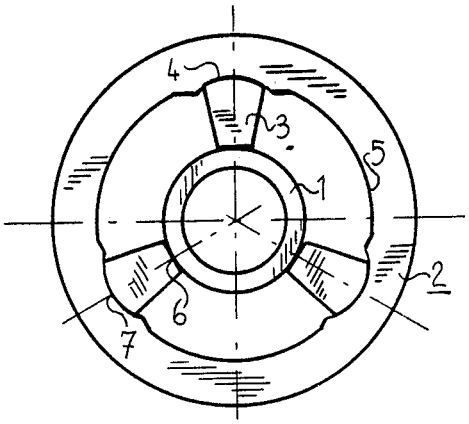

In the different figures, the same references designate the same elements, but for clarity's sake, the dimensions and the proportions of the various element have not been respected.

FIG. 1 is limited to representing the parts of the traveling wave tube useful to the description of the invention. For example, the electron gun of the tube, the collector and the focusing device of the electron beam that are well known in the prior art have not been represented.

FIG. 1 is an exploded view in perspective of an embodiment of the invention in which is used a helix 1 borne by a conical surface, that is generally realized by winding of a wire on a conical mandrel. In FIG. 1, the conicity of the helix has been exagerated for reasons of clarity.

Three rods or supports 3, made of dielectric material of constant height h, support the helix. Three rods disposed at 120° from one another are generally used. These rods are inserted into grooves 4, the depth p of which increases in fonction of the diameter of the helix. These grooves 4 are realized on the internal surface of a sleeve 2 generally metallic and sealed under vacuum, the external surface of which is cylindrical. It can be seen from FIG. 1 that the internal surface of the sleeve comprises cylindrical sectors 5 that connect the prismatic shaped channels 4 into which the dielectric supports 3 are inserted. FIG. 2 is a view in perspective showing the end of the sleeve 2, without the helix and the dielectric supports, that contains the part of the conical helix having the greatest diameter.

The internal section of the sleeve can have a form other than that which is represented by way of example in FIGS. 1 and 2. This internal section must, however, have a symmetrical revolution about the axis of the tube, if the grooves are excluded.

The interest of the internal section of the sleeve that is represented in FIGS. 1 and 2 is that in the interval between the channels, the sleeve comprises internally and externally cylindrical sectors 5 of constant thickness. These cylindrical sectors of constant thickness allow to realize easily the function of several conical helix delay lines.

The invention thus allows for supporting a conical helix to utilize dielectric rods of constant height and standardized manufacture, which are thus inexpensive.

Figure 4:
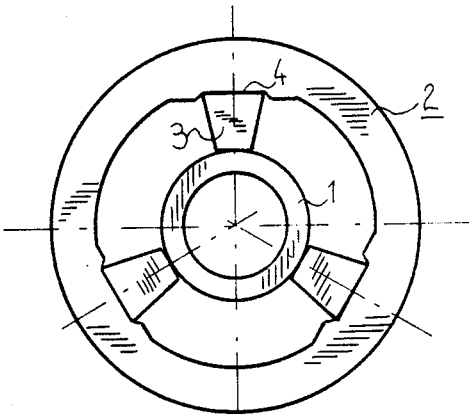
Figure 5:
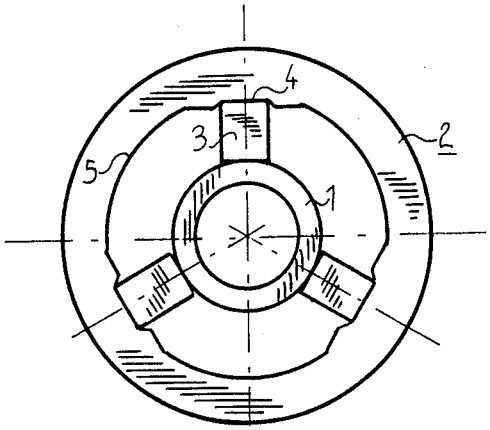
Figure 6:
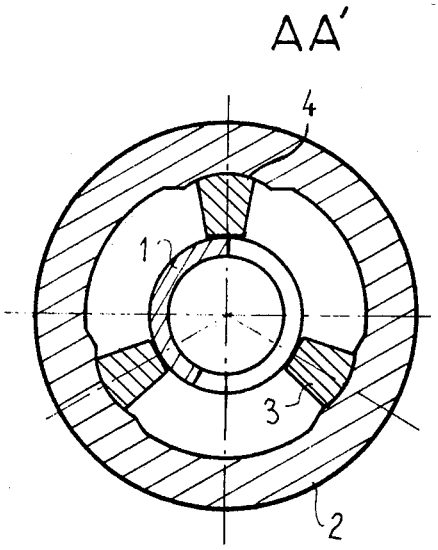
FIGS. 6 and 7 are transversal cross-sectional views similar to FIGS. 3–5 showing the varying depth and conical coil.
Figure 7:
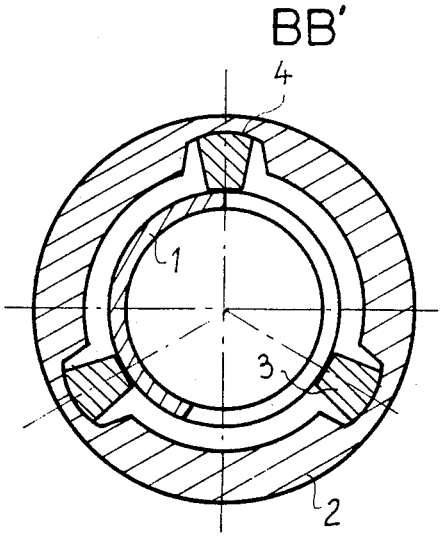

FIGS. 3, 4 and 5 are transversal cross-section views where can be seen: helix 1—that can be borne by a cylindrical or conical surface-dielectric supports 3 in these figures three dielectric supports have been represented but they can be of a number different to three-sleeve 2, that is externally cylindrical and the internal surface of which comprises grooves 4 into which are inserted the dielectric rods. In the interval between the channels the sleeve comprises, externally and internally, cylindrical sectors 5 of a constant thickness.

FIGS. 3, 4 and 5 show that dielectric rods 3 presenting different sections can be used.

In FIG. 3, the dielectric rods 3 comprise two cylindrical sectors 6, 7 that face each other and are in contact with the helix and with the grooves of the sleeve. In FIG. 4, the dielectric rods 3 have a trapezoidal section. In FIG. 5, the dielectric rods have a rectangular section.

The sleeve used in the present invention can be manufactured by hammering. A core is realized having a shape corresponding to the internal surface of the sleeve bearing the grooves. A cylindrical tube, made of copper, for example, is disposed around this core. The tube assumes the shape of the core under the hammering process. The core is extracted from the sleeve thus produced.

Other manufacturing processes can be used such as drifting, shaping by explosion . . . as well as other materials, such as stainless steel, titanium . . . .

If it is required to utilize a device for periodic permanent magnet focusing device, the external surface of the sleeve is rendered cylindrical by lathe machining.

When the focalization is realized by solenoid, this last step is non indispensable.

We claim:

1. Traveling wave tube comprising a helix-type delay line placed in a sleeve cut with grooves, to which it is fixed through the intermediary of dielectric supports of constant height, inserted into the grooves, wherein the helix-type delay line is borne by a conical surface and the depth of the grooves increases with the diameter of the line.

2. Tube according to claim 1, wherein the external surface of the sleeve is cylindrical.

3. Tube according to claim 1, wherein the sleeve comprises in the interval between the channels, internally and externally, cylindrical sectors, of constant height.

4. Tube according to claim 1, wherein the dielectric supports comprise two cylindrical sectors facing each other and that are in contact with the helix and with the grooves of the sleeve.

5. Tube according to claim 1, wherein the dielectric supports have a trapezoidal section.

6. Tube according to claim 1, wherein the dielectric supports have a rectangular section.

7. Process of manufacturing a sleeve for a traveling wave tube according to claim 1, wherein it comprises the following steps:

realization of a core having a shape corresponding to the internal surface of the sleeve bearing the grooves of increasing depth;

disposition of a cylindrical tube about this core;

shaping of the core on the cylindrical tube by hammering;

extraction of the core from the sleeve thus produced.

8. Process according to claim 7, wherein the external surface of the sleeve is rendered cylindrical by lathe machining.

* * * * *